US008464452B2

(12) United States Patent
Harper

(10) Patent No.: US 8,464,452 B2
(45) Date of Patent: Jun. 18, 2013

(54) FIREARM MAINTENANCE SYSTEM

(76) Inventor: John Harper, Lawrenceburg, IN (US)

( * ) Notice: Subject to any disclaimer, the term of this patent is extended or adjusted under 35 U.S.C. 154(b) by 353 days.

(21) Appl. No.: 12/655,562

(22) Filed: Dec. 31, 2009

(65) Prior Publication Data

US 2011/0154706 A1 Jun. 30, 2011

(51) Int. Cl.
*F41A 9/62* (2006.01)

(52) U.S. Cl.
USPC ..... 42/1.03; 42/1.01; 42/1.02

(58) Field of Classification Search
USPC ..... 42/1.01, 1.02, 1.03
See application file for complete search history.

(56) References Cited

U.S. PATENT DOCUMENTS

| | | | | |
|---|---|---|---|---|
| 6,286,240 | B1 * | 9/2001 | Collins | 42/70.08 |
| 6,898,890 | B2 * | 5/2005 | Gaber | 42/123 |
| 7,441,491 | B2 * | 10/2008 | Snow | 89/33.02 |
| 8,109,023 | B2 * | 2/2012 | Pikielny | 42/1.01 |
| 2003/0061753 | A1 * | 4/2003 | Glock | 42/1.02 |
| 2008/0282595 | A1 * | 11/2008 | Clark et al. | 42/1.01 |
| 2009/0277065 | A1 * | 11/2009 | Clark et al. | 42/1.03 |
| 2010/0139141 | A1 * | 6/2010 | Pikielny | 42/1.03 |
| 2010/0223829 | A1 * | 9/2010 | Ufer et al. | 42/1.03 |
| 2010/0265071 | A1 * | 10/2010 | August et al. | 340/572.7 |
| 2010/0299985 | A1 * | 12/2010 | Delgado Acarreta | 42/1.03 |
| 2011/0067282 | A1 * | 3/2011 | August et al. | 42/1.03 |
| 2011/0072703 | A1 * | 3/2011 | Ferrarini et al. | 42/1.01 |
| 2011/0252684 | A1 * | 10/2011 | Ufer et al. | 42/1.03 |

* cited by examiner

*Primary Examiner* — Samir Abdosh
(74) *Attorney, Agent, or Firm* — R. Christian Macke

(57) ABSTRACT

A firearm maintenance system wherein a count for the number of times the firearm is fired is kept and stored in memory that is resident on the firearm. Also installed on the firearm are a shot counter device, including an inertia switch, a communication card, and an extended life battery. An epoxy resin encases the memory, shot counter device, communication card and battery to protect them from detrimental environmental effects. The life of various component parts of the weapon are tracked against the shot count of the weapon and replaced at appropriate intervals. Weapon maintenance is performed by transferring the weapon's data from the weapon's memory to an operator laptop computer wherein an algorithm analyzes the data and advises the operator to take necessary maintenance steps, such as replacing parts that have reached the end of their useful life. After performing such necessary maintenance, the operator makes a maintenance data submission that updates the memory to reflect the maintenance data steps taken. Data is transferred between the weapon and laptop computer via infrared communication such that no electrical connection to the weapon mounted device is necessary to communicate data into or out of the device.

2 Claims, 4 Drawing Sheets

FIREARM MAINTENANCE SYSTEM

FIELD OF THE INVENTION

The present invention relates generally to a system for maintaining firearms, and is particularly directed to a system wherein a shot counter device is mounted on a firearm and accumulates and retains data about the maintenance status of the firearm that is transmitted and analyzed by a computer.

BACKGROUND OF THE INVENTION

Effective maintenance of a firearm begins with an effective and regularly scheduled way to schedule and perform routine maintenance on the firearm. In the past, maintenance was performed when an individual component failed, or began to fail. At that point, the firearm would generally be rebuilt, repairing or replacing all components of the firearm subjected to wear and tear during usage.

In recent years, preventive maintenance systems have been used to anticipate failure of the firearm, or of individual components, and to implement maintenance procedures to repair or replace components of the firearm before they fail. Such preventive maintenance systems have been implemented in two different methods. In one method the age of a weapon is tracked and preventive maintenance steps taken therein at a certain chronological time on a calendar, i.e. once per year, once every six months, etc. Alternatively, another method is to track how many times the firearm is operated and to then implement preventive maintenance procedures at a point of usage before components of the firearm begin to fail.

Both the calendar based preventive maintenance method and usage based preventive maintenance method have drawbacks. First, both generally result in complete overhauls of the firearm when the maintenance is performed, even though some components have longer useful lives than others and do not need to be repaired or replaced. It would be preferable to track the usage of individual components on the firearm and only perform maintenance repairing or replacing a component at the end of its useful life.

In addition, calendar based preventive maintenance systems result in unnecessary maintenance being performed on little used firearms while missing necessary maintenance on heavily used firearms. It is thus preferable to utilize usage based preventive maintenance procedures because it avoids the wasteful maintenance of little used firearms, as well as reducing the catastrophic failure that result from a lack of maintenance of heavily used firearms. Usage based preventive maintenance systems, however, require effective tracking of usage, generally accomplished through the use of some form of shot counter device to quantify the number of times the firearm is discharged, and the means for displaying or interpreting the data generated by the shot counter device.

A preventive maintenance system for a firearm that is dependent on tracking the usage of the firearm is costly because it necessitates the addition and use of a shot counter. In addition, such preventive maintenance systems are also costly because the maintenance that is performed, based upon usage, is generally a complete overhaul, repair or replacement, of all of the components of the firearm prone to wear and tear. The individual components are not monitored or tracked, so components with relatively long useful lives are unnecessarily repaired or replaced, an inefficiency even in the usage based preventive maintenance system.

The importance of an effective and efficient preventive maintenance system for maintaining firearms cannot be overstated, particularly for large entities such as police departments or military units wherein life and death depend on the reliable operation of firearms. While it is most important to such entities, it is also most difficult to implement a preventive maintenance system for such a large group of weapons because a large amount of data (shot counting for each firearm) must be accurately maintained. A preventive maintenance system for large scale firearms maintenance, such as police and military entities, must be effective and efficient and regularly implemented. If not diligently implemented, the reliability of all firearms is suspect and the system fails.

The tracking of a weapon, and the maintenance history of the weapon, becomes an enormous and time consuming task when large numbers of weapons are involved. Tracking all of the maintenance steps performed on a weapon and attaching it to the weapon's serial number is complex when weapons are put into service in one location, taken out of service and sent somewhere else for maintenance, repaired, and put back into service in another location. The logistics and data entry requirements are only made more complex when this process is repeated. Any errors in data entry, such as in weapon or shot counter serial number, maintenance history, etc., will compromise the whole system and will probably only be identified if the weapon fails, a potentially catastrophic occurrence. It would be advantageous to provide a preventive maintenance system wherein the entire history of a weapon, including the number of times its been fired, when and how it or its components have been repaired or replaced, is in a database stored on the weapon itself and accessible through a portable data acquisition tool. Such a system allows on site maintenance of the weapon, eliminates the need to correspond everything to the weapon serial number, eliminates the need to maintain a weapon maintenance database, and eliminates errors in transferring data when the weapon is put into or taken out of service.

For the preferred usage based preventive maintenance system, the first obstacle is to provide a reliable device and method for counting how many shots are fired. One major consideration when providing a device for counting shots is how the shot counter is powered and what kind of life the power supply has. For a shot counter mounted on a weapon, it is important that the power supply for the shot counter be small and light and that it have a long life. Failure of the power supply results in a failure of the shot counter and, effectively, a failure of the entire preventive maintenance system. Any power supply that itself requires maintenance, such as changing or charging of a battery, will be a significant drawback because the entire preventive maintenance depends on it.

The life of the power supply battery, and the shot counter, is defined by both the capacity of the battery and the current draw of the shot counter circuit. That is, the life of the battery can be extended by either making the battery larger, or making the system power requirements smaller. If an electrical circuit is designed for the shot counter that uses very little power, the life of the battery, and indeed of the shot counter, is greatly extended.

As set forth in more detail herein, the countervailing design considerations of long life but small size are accommodated with the present invention by using a Lithium battery and a shot counter circuit that draws no power until either a mechanical counter device "wakes" it up to count or it receives a wakeup signal to communicate. The shot counter device of the present invention utilizes an inertia switch, a mechanical on/off switch that is sensitive and closes only when the firearm is fired. The inertia switch is designed and specified so that it can distinguish between a drop, shake or crash of the firearm and a shot because it includes a spring loading specifically designed for the weapon's characteristics to close only upon detection of a shot, and to close only once for each shot, i.e. the spring is defined with a constant that prevents "bouncing" of the counter. Providing a lithium battery powered circuit, which only draws current momentarily when a shot is detected or when communicating, the life of the battery/shot counter eliminates the need to provide for replacing the battery.

The inertia switch provided is similar to that described in U.S. Pat. No. 5,566,486 to Brinkley which patent is assigned to Accu-Counter, just as the present application and invention disclosed herein is. By providing a shot counter assembly with a sufficiently long life without requiring battery replacement or any other maintenance, the shot counter device is permanently installed on the firearm assuming it will never have to be repaired or the battery replaced. Because there is no need to change batteries or otherwise maintain the shot counter device, this leads to the significant benefit that the entire shot counter device may be permanently enclosed in a housing that is impervious to moisture, temperature or other damaging environmental factors. It is a critical advantageous feature of the present invention that the firearm mounted shot counter device is permanently installed, sealed and encapsulated to protect it from harsh environmental factors of moisture and temperature, with a battery and counter circuit of sufficiently long life that the shot counter device will not need to be replaced. As set forth in more detail herein, the present invention accomplishes this with a Lithium battery and a counter circuit that only "wakes up" upon closure of an inertia switch when a shot is detected or when communicating. It is contemplated, however, that other long life shot counter devices that meet those criteria may be used without departing from the principles of the present invention, specifically that the shot counter device is permanently installed on a weapon in an environmentally impervious housing with the capacity to communicate data stored in the shot counter device without requiring an mechanical contact for such communication, as set forth in more detail below.

Preventive maintenance of a firearm based upon usage of the firearm requires a very accurate count so the integrity and reliability of the counter device is of utmost concern. If the shot counter device is inaccurate one time for one weapon, the integrity of all of the maintenance of all of the weapons is called into question and the preventive maintenance system fails.

A long life for the shot counter device is further necessary because one of the anticipated benefits of the use of the present firearm maintenance system is that the life of firearms maintained thereby will be extended. Specifically, the present system will make it effective to replace individual components of the firearm as they wear out, thereby extending the useful life of the firearm.

It is a very difficult task to track the usage of individual components of a firearm but when it is done accurately, as by the present invention described in more detail herein, it saves a great deal of expense and labor to replace components only when they reach the end of their useful lives instead of replacing all the components every time a calendar based or usage based system indicates it is time for maintenance of the firearm.

Prior art shot counters have included many methods and devices for making the data (i.e. number of shots fired) available to a user of the firearm. The '486 patent to Brinkley, for example, discloses the use of a digital display on the weapon. U.S. Pat. No. 7,143,644 to Johnson, on the other hand, alludes to the use of shot counter data by transferring it to a computer for analysis, but does not describe a method or system for such.

Providing a system wherein a firearm's usage history can be analyzed, to facilitate preventive maintenance on the firearm, is clearly desirable. Further, a usage based preventive maintenance system wherein separate components of a firearm can be tracked and maintained is desirable, particularly to large scale firearms owners such as military and police organizations.

In addition to the design constraints for the weapon mounted shot counter device, a usage based preventive maintenance system requires a reliable method and hardware and software to store the data, communicate the data to a drive to analyze the data, and update the data to reflect historical usage and maintenance. The present invention addresses and provides solutions for issues pertaining to the reliability of the data, where the data is stored and how it is communicated and how the data is analyzed and by whom or what device performs the analysis.

A preventive maintenance system for firearms using some of the principles of the present invention is in use by the U.S. Navy and known as the WEAR system. It is a usage based preventive maintenance system that uses an inertia switch and tracks weapon usage. Data is uploaded to a computer from a firearm mounted shot counter device for analysis, and then maintenance is performed as indicated by the analysis. The significant drawback of the WEAR system is that the data for all weapons is stored in a central database; the firearm mounted shot counters are simple devices that count shots and communicate that count for analysis, and they do not contemplate or provide for data to be communicated into the shot counter device that is mounted on the weapon. This creates the significant disadvantage that the WEAR system, to be effective, requires accessibility to the central database anytime and from anywhere to maintain the firearm. It is also disadvantageous because data entry errors in the serial number or inputting of data invariably occur. As set forth in more detail herein, the present invention moves the data storage onto the firearm itself, so that the entire shot count and maintenance history of a firearm will be stored on the firearm itself; there will be no need to access, or even retain, a centrally located maintenance file prior to performing maintenance thereon, and there will be no data entry errors in putting in the serial number. There is no need to track the firearm maintenance related to a serial number. The entire database is right there on the weapon.

The constraints and challenges to providing a reliable shot counter, with a related system that allows for storage and analysis of data, including firearm maintenance data, are significant. The present invention addresses all of the challenges including the new approach of storing all data pertaining to a firearm's shot count history and maintenance history on the firearm itself in durable, permanently installed memory. The prior art need to organize, maintain and protect data related to an identification number for each weapon on another device, such as a central computer, is eliminated.

As set forth in more detail herein, the firearm mounted shot counter device of the present invention is encapsulated and protected from the environment, including provisions for communicating data to and from the device without requiring any electrical connection. In the most preferred embodiment, the present invention utilizes infrared radiation (IR) communications, but other forms or wireless communications, including radio frequency (RF) and other forms, are contemplated and do not depart from the principles of the present invention. A long life Lithium battery is used in conjunction with a low power circuit that only draws power when it "wakes up" to count or while communicating, so the entire device including the battery may be encapsulated and permanently installed on a weapon without replacing the battery.

The firearm mounted shot counter device of the present invention, described in more detail herein, cooperates with a laptop computer having a weapon maintenance algorithm thereon to provide a durable and efficient system for firearm maintenance. Upon receiving data from the firearm mounted shot counter device, the data, obtained wirelessly through a data collection device, the laptop quickly analyzes the data and provides a report to the operator assessing the maintenance status of the firearm, including a component by component analysis, and recommendations to the operator as to which components need to be repaired or replaced. After performing the necessary maintenance on the components of the firearm, the operator updates the maintenance history of the firearm to reflect the steps he performed, i.e. he confirms to the laptop which components he repaired or replaced and when he did so, and that data is transferred back into the memory on the firearm itself, again wirelessly using IR communication.

Any laptop computer, loaded with the weapon maintenance algorithm of the present invention, may be used to analyze the status of any firearm equipped with the shot counter device described herein including the output and input communication devices. There is no longer a need to maintain data regarding a weapon's usage or maintenance history because it is resident on the weapon itself in a form that is understood and interpreted by a laptop programmed with the weapon maintenance software.

The firearm maintenance system described in more detail herein addresses the failings and drawbacks of the prior art to provide a reliable and efficient means and method for maintaining firearms that will extend the life of firearms while also eliminating expense and labor associated with database organization or associated with unnecessary repairs to components of the firearm.

SUMMARY OF THE INVENTION

The present invention is a system for maintaining a firearm having a means for counting shots fired by the firearm, means for tracking individual component parts of the firearm against the number of shots fired by the firearm, and means for timely advising maintenance personnel when an individual component of the firearm is nearing or has reached the end of its useful life and must be replaced. The means for tracking individual parts in the most preferred embodiment comprises memory wherein maintenance data is stored pertaining to individual components of the firearm, including, without limitation, time in service, number of shots fired while the component has been in service and the prior history of the repair of the component.

The means for tracking individual parts also includes means for comparing maintenance data pertaining to the component to predefined lifecycle values reflecting a useful life for the individual component being analyzed. A signal is sent to an operator performing an analysis to timely advise the operator when an individual component is nearing or exceeds the predefined lifecycle value, i.e. when it is nearing the end of its useful life.

In a significant feature of the present invention, the memory wherein maintenance data pertaining to the firearm is retained is resident on the firearm. A means for communicating the maintenance data from the memory to the means for comparing is provided wirelessly such that no mechanical connection between the memory and the means for comparing is required.

In the most preferred embodiment of the present invention, the means for comparing is provided by a laptop computer programmed with a weapon maintenance algorithm. The laptop and algorithm provide a means for timely advising maintenance personnel when a component part is nearing or has reached the end of its useful life.

The means for communicating data from the shot counter device and the laptop comprises cooperative wireless communication devices between the memory and the laptop computer allowing data to be both transmitted from the memory to the laptop computer and transmitted from the laptop computer to the memory. In the most preferred embodiment of the present invention the means for communicating includes infrared communication devices, namely: a communication card mounted on the firearm within an impervious housing having a receiving photo diode and a transmitting LED; and a data collection device having a receiving photo diode and transmitting LED communicating to said laptop computer.

The maintenance system of the present invention also includes means for updating maintenance data stored in the memory by transmitting updated maintenance data into the memory. After a maintenance operation is performed on the firearm, such as repair or replacement of a component, the operator inputs updated maintenance data reflecting the operation. In the most preferred embodiment of the present invention, the infrared communication devices are used to transfer the updated maintenance data. This allows the entire firing history and maintenance history of a weapon to be stored in memory, so that by placing the memory on the firearm, the entire history of the weapon is resident thereon. This eliminates the need to store firearm data somewhere else to be accessible and modifiable by referring to the firearm's identification code or serial number.

The firearm mounted device for counting shots of the firearm comprises an inertia switch mounted on the firearm, a processor mounted on the firearm to receive a signal from the inertia switch and increment a shot count value each time a shot is fired, memory mounted on the firearm to store the shot count value, an infrared communication card mounted on the firearm transmitting data to and from the memory, a battery providing power for the processor, memory and communication card, and an epoxy encasing of the inertia switch, processor, memory, infrared communication card and battery wherein an epoxy housing is affixed to the firearm. In the most preferred embodiment of the present invention, the battery is not supplying power until receiving a signal from the inertia switch or the communication card to minimize the current draw on the battery to extend its life and the life of the shot counter device.

DETAILED DESCRIPTION OF THE INVENTION

Figure 1:
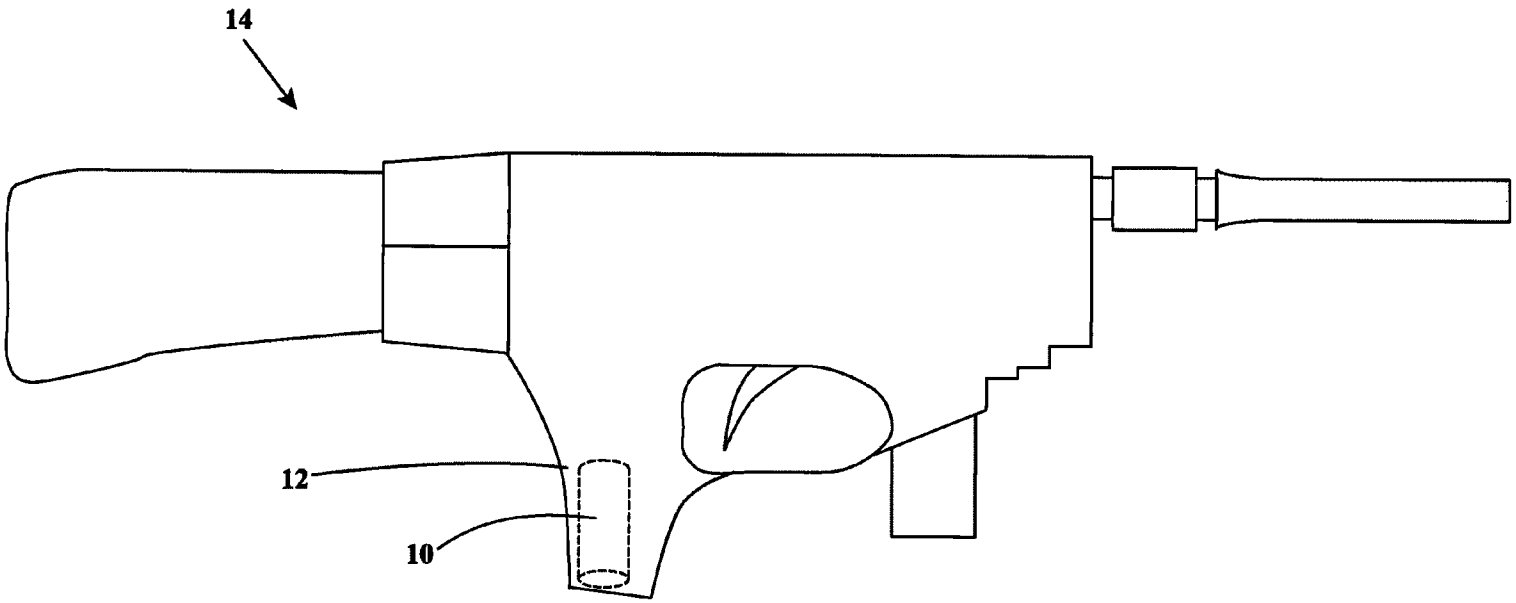
FIG. 1 is a front view of a firearm schematically equipped with a shot counter device in the handle.
Figure 2:
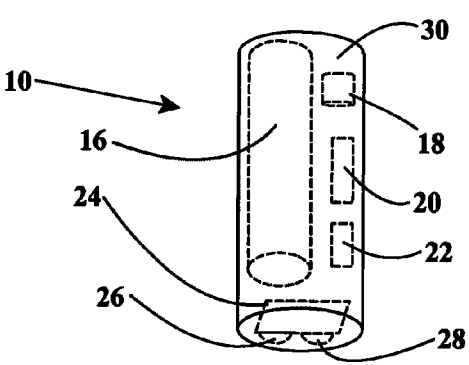
FIG. 2 is the firearm mounted shot counter device schematically with various components encased therein represented in phantom.
Figure 3:
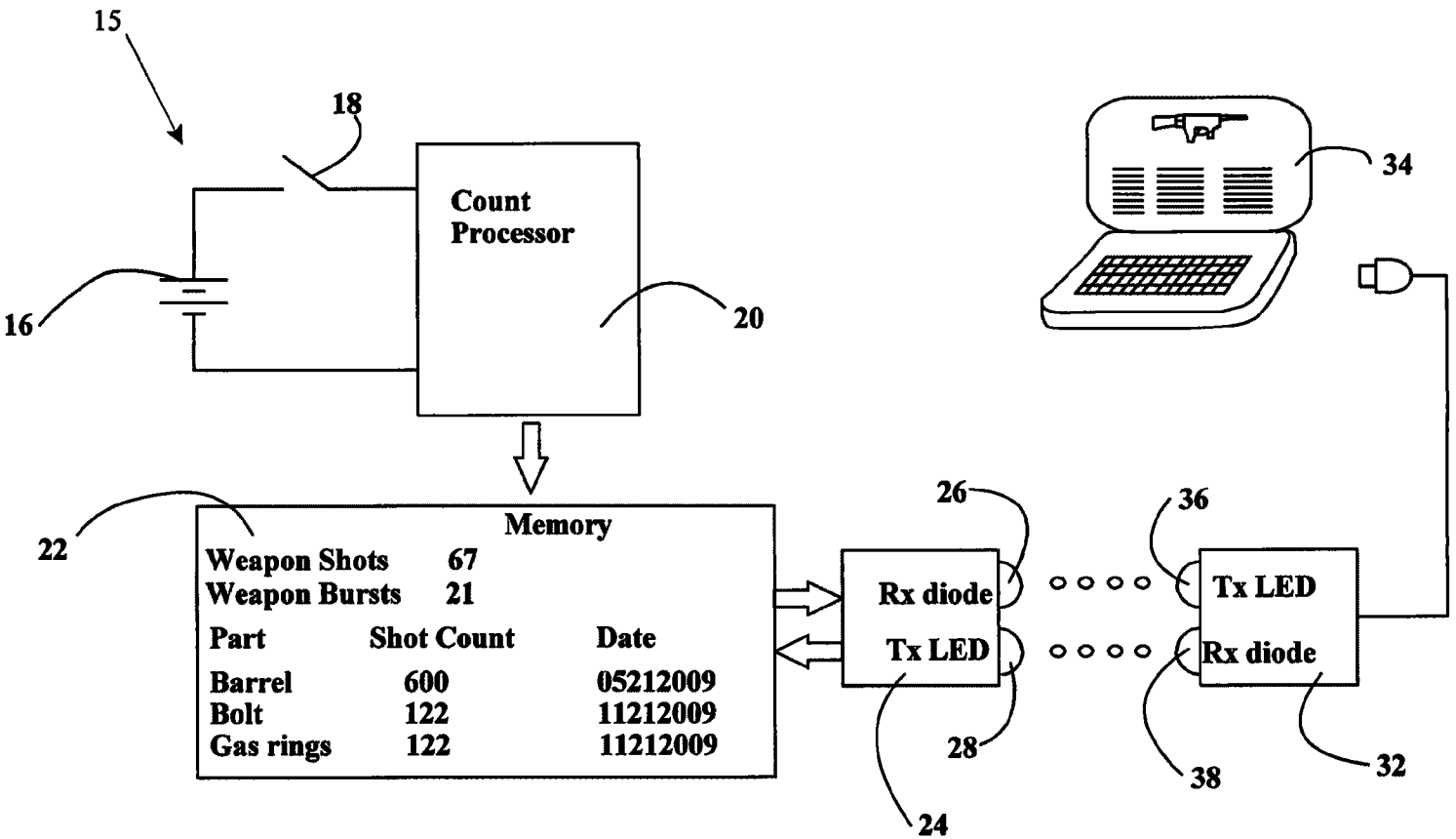
FIG. 3 is a schematic representation of the counter circuit and the communication provisions between various devices of the weapon maintenance system.

The present invention provides a usage based preventive maintenance system for firearms wherein all maintenance data is stored on the firearm itself in a durable and protected device so that succeeding analysis of the health of the firearm reflects the prior maintenance performed on the firearm as well as a running total of shots fired by the firearm. The present firearm maintenance system is advantageous because it allows individual components of a firearm to be analyzed and, if necessary, repaired or replaced, rather than overhauling the entire firearm, and it does so by accessing the shot count and maintenance history stored entirely on the firearm itself.

The most important element of the present system is the firearm mounted shot counter device 10. Shown for illustration purposes as a cylinder 10 encasing multiple components, the shot counter device 10 is typically mounted in the handle 12 of a weapon 14. The shape and mounting position on the firearm 14 of the shot counter device 10 shown are non-limiting examples. Other physical shapes, dimensions and locations are specifically contemplated so that an alternative mounting does not depart from the principles of the present invention. The preferred embodiment of the present invention provides a shot counter device 10 resident on a firearm 14, that has capacity to store and retain all shot count and maintenance data pertaining to the firearm 14, requiring communication of data out of the shot counter device 10 and into the shot counter device 10 to update maintenance status.

In the most preferred embodiment of the present invention, a means for counting shots by the firearm comprises a circuit 15 including a battery 16, a shot counter switch 18 and a count processor 20. The count processor 20 increments the "shot count" of the firearm 14 each time a shot is detected, and communicates the updated shot count to memory 22. That is, when the weapon 14 is fired, the switch 18 sends a signal to the processor 20 and the processor 20 increments and updates the shot count stored in memory 22.

The data retained and stored in memory 22 is accessed through a communication card 24 (CommCard), connected to the memory 22 such that data may be read from or transmitted to the memory 22. In the most preferred embodiment of the present invention CommCard 24 comprises a photo diode 26 and light emitting diode (LED) 28 mounted thereon so that data in memory 22 may be transmitted out or modified through CommCard 24 using infrared radiation (IR). It is contemplated that other forms of communication other than IR may be used to communicate data into and out of memory 22 included within the shot counter device 10, so that the use of other communicating devices and methods, including other wireless forms of communication such as radio frequency (RF), do not depart from the principles of the present invention. In an important aspect of the present invention, the long life power supply battery 16, shot counter switch 18, processor counter 20, memory 22 and communication card 24 are all contained in a housing material 30 and are resident on the firearm 14 (see FIG. 1). The preferred embodiment of the present invention contemplates the use of the shot counter switch 18, circuit 15, processor 20 and memory 22 as the means for counting shots fired by the firearm 14, but other equivalent devices and methods are contemplated for counting the number of shots, such as, and without limitation, other shot counter devices having memory for data storage that is housed in a housing and is accessible through wireless communications with the means for counting shots.

In the most preferred embodiment of the present invention, the shot counter switch 18 comprises an inertia switch that is sensitive to detect firing of the firearm 14 by being able to distinguish firing from dropping or other vibration of the firearm 14. For a simple spring biased inertia switch, such as that referenced in U.S. Pat. No. 5,566,486 to Brinkley, also owned by the assignee of the present application, the spring and the mass weight of the ball switch mechanism are tailored to various types of firearms, the mechanical characteristics being sufficient to switch closure when a shot is fired while preventing multiple closures (i.e. "bouncing") of the inertia switch 18 when it is fired. The processor 20 will increment the shot count by one each time it detects closure of the switch 18, and because switch 18 is debounced because of its mechanical properties and closes only upon detection of a shot communicated out by processor 20 and retained in memory 22, an accurate count is obtained and retained.

While the simple inertia switch 18 is the most preferred shot detection device contemplated by the present invention, the use of other switches having provisions for debouncing the signal and alternative sensitivity provisions may be used to provide the shot count signal to the processor 20 without departing from the principles of the present invention.

The present invention comprises shot counter switch 18, in a housing 30 with a power supply 16 and counter processor 20, memory 22 and communication card 24 also mounted therein. In the most preferred embodiment of the present invention the housing 30 comprises an epoxy resin that is impervious to moisture and temperature to protect the components mounted therein. In a critical feature of the present invention, the housing 30 is designed to communication with CommCard 24 without requiring physical contact with the housing or any components of the shot counter device 10. Specifically, the epoxy resin housing 30 is transparent adjacent to the photo diode 26 and LED 28 mounted on the communication card 24 to allow IR communication with the shot counter device 10. In this way, a cooperative infrared communication device is able to access the data retained in memory, and to input new data into memory 22, without requiring any physical contact with the housing 30, CommCard 24 or any other element of the shot counter device 10. The shot counter device 10 is mounted and oriented on the weapon 14 such that the photo diode 26 and LED 28 are visible for IR communications therewith.

Tracking the number of times the firearm 14 is fired with shot counter device 10 is only part of the preventive maintenance system for the firearm 14. The data stored in memory 22 on the firearm 14 is accessible such that it may be analyzed by using a data collection device (DCD) 32 that communicates to an operator interface device 34. In the most preferred embodiment of the present invention, the data collection device 32 has a transmitting LED 36 and receiving photo diode 38 that communicates via infrared radiation to the communication card CommCard 24 located in housing 30 of shot counter device 10. No wiring connection is necessary between the data collection device (DCD) 32 and the shot counter device 10 to access or modify data stored in memory 22. In the most preferred embodiment of the present invention, communication is completely wireless between the shot counter device 10 and the data collection device (DCD) 32. Wireless communication between the firearm mounted device 10 and the data collection device 32 is important because the epoxy housing 30 completely encapsulates the components battery 16, switch 18, processor 20, memory 22 and communication card (CommCard) 24 of the firearm mounted device 10, protecting them from moisture, temperature and environmental hazards while eliminating the need for any wiring or electrical connection to access the data.

The data collected by data collection device (DCD) 32 from memory 22 resident on the firearm 14 is then communicated to an operator interface device 34. In the most preferred embodiment of the present invention, the data is communicated from the data collection device (DVD) 32 via a USB connection to a laptop personal computer 34.

Figure 4:
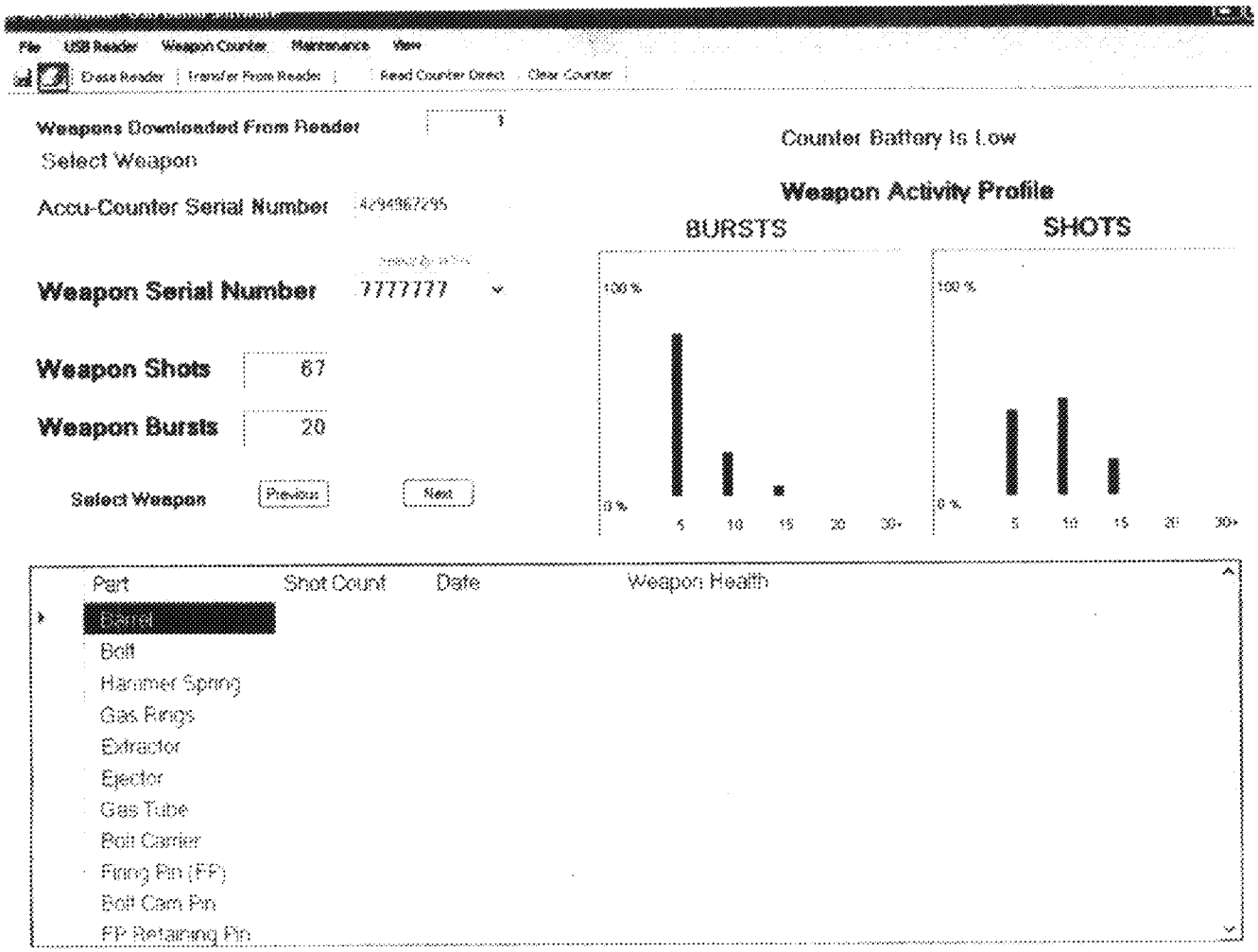
FIG. 4 is a sample report without data generated by the laptop with the weapon maintenance software resident thereon that an operator then uses to perform appropriate maintenance on the firearm.
Figure 5:
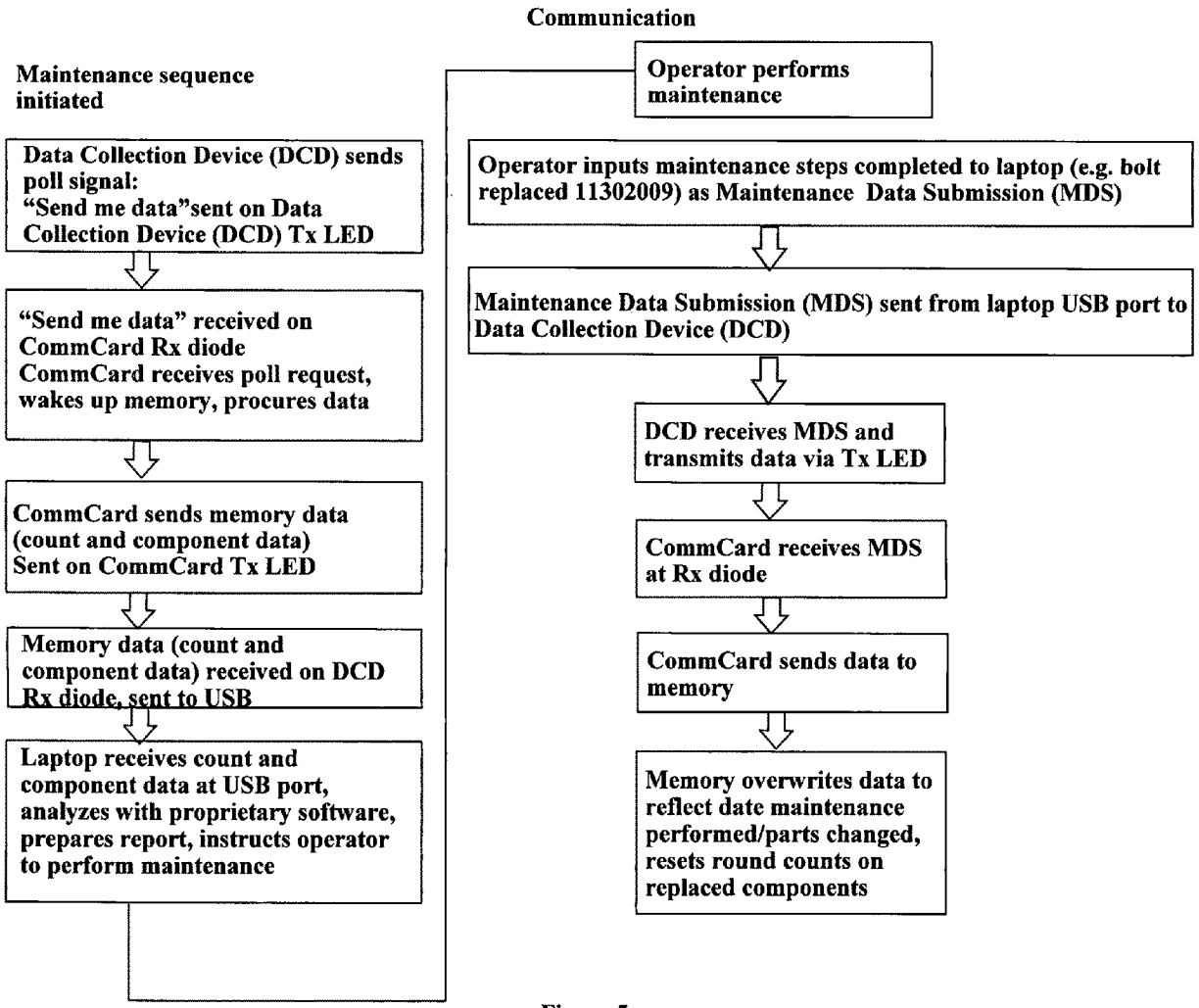
FIG. 5 is a flow chart depicting the transfer of data from the shot counter to the laptop and back again that occurs in the weapon maintenance system.

The laptop 34 is programmed with an algorithm that analyzes the data received from memory 22 and provides a weapon report to an operator, such as the screen depicted in FIG. 4. Specifically, the algorithm calculates the number of times the weapon has been fired for each wear and tear component of the firearm listed in FIG. 4 and directs the operator to perform maintenance on any component according to predefined lifecycle values for the kind of weapon and component being analyzed.

The data communicated from memory 22 and displayed on laptop 34 includes identification information such as weapon serial number, shot counter serial number, and summary information about the number of shots and bursts fired by the weapon 14 (FIG. 4). For example, FIG. 4 illustrates the analysis of a weapon having a barrel, bolt, hammer spring, gas rings, extractor, ejector, gas tube, bolt carrier, firing pin, bolt cam pin, and firing pin retaining pin, all of which will periodically require repair or replacement. The memory 22 resident on the firearm 14 stores data of how many times the firearm has been fired since each component was replaced (see "SHOT COUNT" column next to component list). The data from memory 22, displayed to the operator on the laptop 34, displays the components, shot count for each component, and the date the component was replaced. The laptop 34 receives the data and calculates and displays the "WEAPON HEALTH" for each component by comparing the component shot count to predefined lifecycle values for each component. After the laptop runs the analysis algorithm, maintenance recommendations are displayed to the operator, typically directing him to replace components of the weapon that have poor "WEAPON HEALTH". For example, if gas rings on a weapon have been fired 600 times, and the predefined lifecycle value for gas rings is 800 rounds, the "WEAPON HEALTH" of the gas rings is 25 percent. The laptop 34 sends an onscreen alarm to the operator that gas rings replacement is necessary.

Based upon the report provided by the laptop 34 and any maintenance recommendations on alarms displayed, the operator then performs whatever maintenance is required on the firearm 14. The operator then inputs information into the laptop 34 indicating that maintenance was performed, specifically which if any of the components were repaired or replaced. In the above example, operator input data would indicate that the gas rings were replaced on the date they were replaced. This updated data is then communicated in a Maintenance Data Submission (MDS), to reset the gas rings "SHOT COUNT" to zero in memory 22 for the individual component gas rings through the USB connection from laptop 34 to data collection device (DCD) 32 and via IR to the communication card CommCard 24 mounted in the shot counter device 10. The firearm 14 is then put back in service with the updated information regarding its components so that the next time the data collection device (DCD) 32 and laptop 34 access the data in memory 22, the data communicated will reflect the updated data for each component, including those reset to zero when replaced previously.

The cooperative communications between the weapon mounted memory 22 and laptop 34, along with the weapon analysis algorithm on the laptop 34 provide the means for tracking individual components of the firearm 14 against the number of shots fired by the firearm 14. Other equivalent structures are contemplated by the present invention such as, without limitation, smart hand held devices that perform a weapon analysis function without requiring a laptop running an algorithm. That is, it is contemplated that the data collection device (DCD) 32 and laptop 34 can be combined into a single, smart device dedicated to doing weapon analysis, and providing recommendations and alarms to operators regarding weapon components' health. The preferred embodiment of the present invention contemplates a firearm maintenance system in which all data pertaining to the health of a weapon and its components is resident on the weapon 14. A means for counting shots of the firearm 14 and means for tracking individual components against the number of shots is provided through an analysis algorithm and an operator interface device 34 that analyzes the data, then timely advises the operator when a component is nearing or has reached the end of its useful life through reports, recommendations and alarms to the operator.

The accessing of data by the laptop 34, the subsequent modification of the data to reflect maintenance performed, and the communication of the updated data back to the memory 22 result in the significant beneficial result that all data pertaining to the maintenance of a firearm is stored on the firearm itself. There is no requirement to store the data in the laptop or any other weapon maintenance computer database. The prior art systems of firearm maintenance have vast data input requirements for each weapon and shot counter device. Inputting the firearm model, serial number and service date, as well as the serial number and service date for the shot counter, to perform maintenance on the firearm become a bureaucratic nightmare, consuming valuable resources in manhours spent just inputting data to keep the system up to date. With the present invention, the operator performing the maintenance updates the data when the maintenance is performed and the updated data is communicated back to the shot counter device 10 on the firearm 14 where it will reside unchanged, except for the shot count, until it is next accessed by the data collection device (DCD) 32.

The present invention is an improvement over the prior art because it allows efficient tracking of individual components of a firearm allowing an operator to repair or replace only those components that have reached the end of their useful life. The expense of parts and labor related to unnecessary maintenance is eliminated.

The improvements resulting from the present invention are products of the innovative approach of encapsulating the memory 22 and processor 20 in an environmentally impervious housing and attaching it to the firearm 14, but providing a means for wirelessly communicating information into and out of the encapsulated memory 22. While the most preferred embodiment of the present invention utilizes infrared radiation (IR) communications to make the wireless communication possible, it is specifically contemplated that other forms of wireless communication would function in the same way, so that merely changing the IR communication devices to, for example, a wireless router, does not depart from the principles of the present invention.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

I claim:

1. A system for maintaining a firearm comprising:

means for counting the number of shots fired by the firearm;

means for tracking a shot count for each individual component of the firearm comprising memory resident on the firearm wherein data is stored including the shot count for each individual component of said firearm, said data being updated as maintenance is performed on said firearm;

means for timely advising maintenance personnel when a said individual component part is nearing or has reached the end of its useful life and must be replaced, said means for advising comprising a laptop computer having a weapon maintenance algorithm thereon that compares the shot count for each individual component to a predefined life cycle value for said individual component and sending a signal when any said component is nearing said life cycle value;

cooperative wireless communication devices for transmitting said data from said memory to said laptop computer and for transmitting a maintenance data submission to said memory from said laptop computer after maintenance is performed;

wherein said laptop computer and said weapon maintenance algorithm receive data from said memory, calculate and display the weapon health for each component and subsequently send data to said memory after maintenance is performed on said weapon such that all data is stored on the firearm itself;

a battery supplying power to said means for counting and said means for tracking, said battery providing power only upon detection of a signal such that current draw on said battery is minimized;

said cooperative wireless communication device further comprising a communication card mounted on said firearm having a receiving photo diode and a transmitting LED; and a data collection device comprising a receiving photo diode and transmitting LED, said data collection device communicating to said laptop computer.

2. The system for maintaining set forth in claim 1 wherein said laptop computer further comprises means for sending data to said memory after maintenance is performed on said weapon by transmitting data into said memory through said infrared communication devices.

* * * * *